US006318482B1

(12) United States Patent
Fidtje

(10) Patent No.: US 6,318,482 B1
(45) Date of Patent: Nov. 20, 2001

(54) BLOWOUT PREVENTER

(75) Inventor: Torbjörn H. Fidtje, Bryne (NO)

(73) Assignee: Rogalandsforskning, Stavanger (NO)

( * ) Notice: Subject to any disclaimer, the term of this patent is extended or adjusted under 35 U.S.C. 154(b) by 0 days.

(21) Appl. No.: 09/541,719

(22) Filed: Apr. 3, 2000

(51) Int. Cl.[7] ..... E21B 33/06

(52) U.S. Cl. ..... 175/318; 166/66.7; 175/317; 251/1.1

(58) Field of Search ..... 251/1.1, 1.2, 1.3; 166/66.6, 66.7; 175/317, 318, 324

(56) References Cited

U.S. PATENT DOCUMENTS

| | | | | |
|---|---|---|---|---|
| 2,460,561 | | 2/1949 | Winkelmann . | |
| 2,942,667 | * | 6/1960 | Blood et al. | 175/324 X |
| 2,946,565 | * | 7/1960 | Williams | 175/324 X |
| 3,104,713 | | 9/1963 | Lebourg . | |
| 3,860,067 | | 1/1975 | Rodgers . | |
| 4,076,083 | | 2/1978 | Sizer . | |
| 4,108,257 | | 8/1978 | Sizer . | |
| 4,423,783 | | 1/1984 | Haag . | |
| 4,469,174 | | 9/1984 | Freeman . | |
| 4,729,429 | * | 3/1988 | Wittrisch | 166/66.6 X |
| 4,905,958 | | 3/1990 | Askelund et al. . | |
| 5,020,612 | * | 6/1991 | Williams | 175/317 X |
| 5,366,030 | * | 11/1994 | Pool, II et al. | 175/324 X |
| 5,851,013 | * | 12/1998 | Simons | 251/1.2 X |
| 5,927,401 | * | 7/1999 | Morris et al. | 166/66.7 X |
| 6,125,930 | * | 10/2000 | Moyes | 166/66.7 X |
| 6,167,974 | * | 1/2001 | Webb | 175/318 X |

FOREIGN PATENT DOCUMENTS

88/08917 11/1988 (WO) .

* cited by examiner

*Primary Examiner*—Kevin Shaver
*Assistant Examiner*—John Bastianelli
(74) *Attorney, Agent, or Firm*—Wenderoth, Lind & Ponack, L.L.P.

(57) ABSTRACT

A blowout preventer (10; 110) adapted to be included in a drill string (11; 111) to isolate a downhole portion of an annulus (14; 114) between the drill string and a borehole wall (12; 112). The blowout preventer has a tubular body (16; 116) and an expandable packer means (22; 122) having an inactive or unset position permitting fluidflow through the annulus (14; 114), and a released, active or set position closing the annulus (14; 114). The tubular body (16; 116) has a through-bore (18; 118) aligned with a bore of the drill string and passageways (30; 130) parallel to the through-bore (18; 118) with fluid inlet ports (32; 132) arranged in a manner to be sealingly covered by the packer means (22; 122) in its unset position, and uncovered upon release of the packer means (22; 122) to permit it to expand into its sealing position closing the annulus (14; 114).

10 Claims, 9 Drawing Sheets

FIG. 3
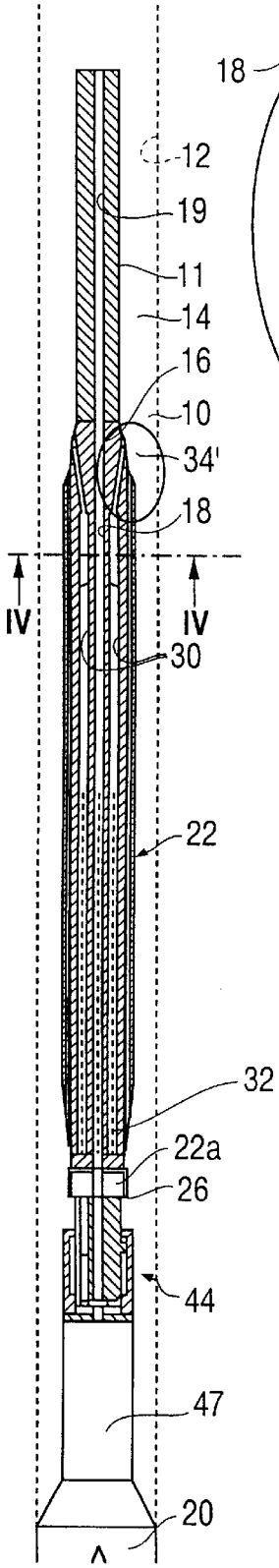
FIG. 3A
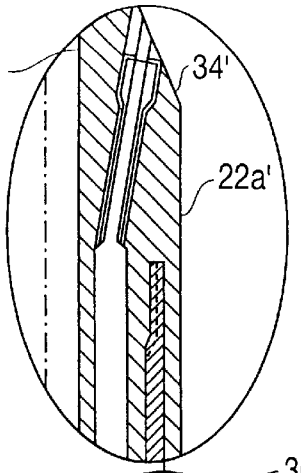
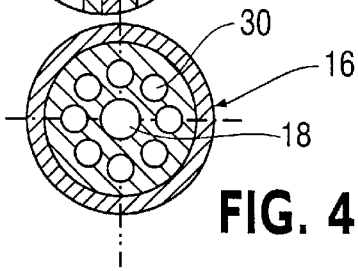
FIG. 4

BLOWOUT PREVENTER

BACKGROUND OF THE INVENTION

1. Field of the Invention

The present invention relates to a blowout preventer adapted to be included in a drill string wherein, upon the occurrence of an uncontrolled blowout of fluid (liquid and/or gas) in a subsea well, the blowout preventer is released in a manner to adopt an activated or set position stopping the blowout.

2. Description of the Related Art

Blowout preventers based on expandable packer elements are often used when drilling top hole sections, i.e. borehole sections near the seabed where high pressure shallow gas pockets may be encountered, to prevent uncontrolled blowout if the pressure downhole of the blowout preventer is higher that provided by the hydrostatic pressure caused by the drilling mud above the packer.

Packer elements of prior art blowout preventers of the above type, such as that disclosed in published PCT application WO 88/08917, are generally designed to be capable of completely isolating the borehole below the packer. In contrast to this, the present invention relates to a blowout preventer permitting a certain degree of controlled fluid leakage to the annulus above the packer, whereby drilling mud may be caused to fill up the entire borehole in an emergency situation associated with a dangerous blowout from the subsea well.

In order to detect any so-called "shallow gas" in top-hole sections in the upper seabed stratum, one or more "pilot holes" are often drilled. The pilot hole is drilled with a smaller diameter than fill bore diameter, in order to permit an increase of the downhole pressure by increasing the pumping rate of the drilling mud. Drilling pilot holes means added costs. Using a blowout preventer according to the invention eliminates the need of initially drilling a such pilot hole, while it also provides the necessary safety with regard to any high pressure zones that may be encountered. The blowout preventer according to the invention which is based on a packer means with a leak feature, is primarily intended for use in the above mentioned top-hole sections, where the borehole is not provided with casing.

When, during prior art drilling, the bit at the end of the drill string encounters a one of the formation having a higher pressure than that produced by the hydrostatic fluid column in the subsea well, any fluid (liquid and/or gas) present will be able to flow into the well and out of it, if no particular measure has been taken to prevent it.

Often, when drilling the upper section of a subsea well, no blowout preventer is used, and normally seawater is used as a drilling fluid when drilling the well. Therefore, when using this prior and conventional drilling technique, it is particularly important to ascertain that there are no high pressure zones to be encountered along the intended drilling path.

When drilling at greater sea depth, however, the formations in the upper strata of the subsea well are less consolidated than those at shallow waters.

The radial expansion capability of the type of packer that is used in prior blowout preventers is limited, and therefore such prior blowout preventers may not be capable of providing a satisfactory sealing around the wall of the wellbore annulus if the formation is unconsolidated or washed out to have a diameter larger than normal. Such insufficient sealing capacity of prior packer elements is uncontrollable and not to be compared with the intended and controllable leaking capability of the blowout preventer of the present invention, the latter permitting a fluid circulation that may be brought to cause the wellbore to be completely filled with drilling mud in an emergency situation such as a blowout.

Prior blowout preventers of the type having inflatable packer elements which are deflated when lowered into the well in their inactive ready position, require a higher internal pressure in their inflated, set position than the pressure prevailing below the packer element in the subsea well. This is due to the fact that the unset packer element itself resists being inflated.

As explained above such inflatable packing elements suffers from insufficient expandability upon inflation. On very deep waters formations might be encountered which are unconsolidated or weak, resulting in a non-uniform borehole wall having varying cross-section along a length thereof, which would necessitate an expansion of the inflatable packing element beyond that for which it is designed. Thus, prior packing elements are not capable of being sufficiently expanded.

SUMMARY OF THE INVENTION

The primary object of the present invention is to eliminate or substantially alleviate drawbacks, deficiencies and restrains on the range of applications of prior art or art technology associated with the drilling for oil and gas, and thus to provide a simple, effective and safe blowout preventer capable of protecting subsea wells against a blowout from an unexpected pressure zone in the formation that is drilled.

This is achieved through the invention, by a type of blowout preventer as introductorily described, incorporating the new and specific features recited below.

In order to be capable of preventing inflow into the subsea well caused by a blowout from an unexpected pressure zone, the pressure in the lowest part of the well has to be increased until it exceeds the pressure prevailing in the formation. According to the invention this is achieved by activating the blowout preventer packer means which comprises a plurality of individual packer elements which, in their activated set position, closes or isolates the annulus between the blowout preventer and borehole wall.

The blowout preventer comprises a tubular body including a packer means adapted to adopt a deactivated or unset and an activated or set position, a latching and releasing means for retaining and releasing the packer means, and an activating means for activating the latching and releasing means. The tubular body of the blowout preventer is provided with passageways through which the fluidflow is directed from downstream inlet ports to upstream outlet ports. The upstream end of each passageway can be provided with one or more nozzles while their opposite closed or downstream end communicates with the annulus through a port.

The radially outer end openings of the ports are normally covered by the individual elements of the packer means when these elements are in their nonactivated position. The packer elements are in the form of relatively wide, self-contained slats one end (the upstream end) of which is attached at the exterior of so the tubular body of the blowout preventer while the free ends of the slats engage the exterior of the tubular body in the inactive position of the packer means.

The packer slats are made from steel or another appropriate metal or metal alloy subjected to a heat treatment imparting a springy property to the slats that tends to urge them radially outwards. The free end portions of the packer slats are kept in their inactive retracted position with the slat bodies biased radially inwards by means of the movable latching and releasing means. Owing to their springy nature the slat elements tend to swing or spring radially outwards with their free outer end portions sealingly engaging the opposite borehole wall upon release of the latching and releasing means.

The blowout preventer also comprises an activator means for activating the packer slat latching and releasing means, the latter advantageously being in the form of an annular latching or retaining part carried by a sleeve-like part sliding on the packer tubular body between a latching and a releasing position. When the latching and releasing means slides along the tubular body to release the slat ends, the radially outer openings of the inlet ports that were covered by a portion of the slats are uncovered to permit fluidflow into the passageways in the tubular body of the blowout preventer, and out therefrom through the nozzles in the outer ends of the passageways.

By adjusting the pump flow rate the downhole pressure can be adjusted to a safe level avoiding fracturing of the formation while preventing inflow into the well. Relatively high flow rates (1000–2000 litre/minute) must be used to achieve this. In this manner fluidflow into the subsea well can be stopped at a minimum of time and heavier drilling mud inflowed into the well, re-establishing the pressure balance of the well even without circulation.

BRIEF DESCRIPTION OF DRAWINGS

Non-limiting embodiments of the invention are described below with reference to the appending drawings, in which:

FIG. 3 is an elevational, partial sectional view, to a smaller scale than FIGS. 1 and 2, showing the blowout preventer in its inactive condition with retracted packer slats;

FIG. 3A illustrates, to a considerably larger scale, an encircled portion of FIG. 3;

FIG. 4 is a cross-sectional view taken along lines IV—IV in FIG. 3;

DETAILED DESCRIPTION OF THE INVENTION

Figure 1:
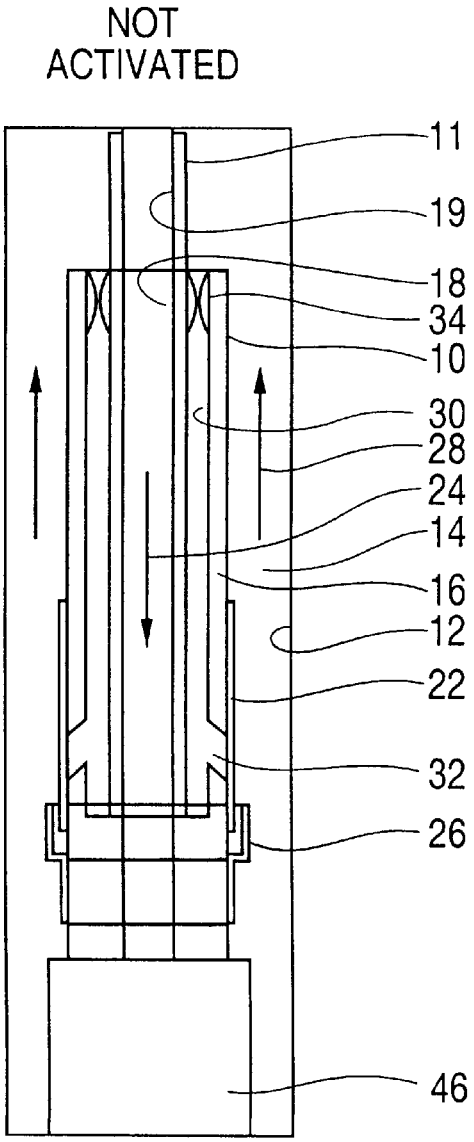
FIG. 1 is a schematic sectional view of a blowout preventer according to the invention, with the slats of its packer means in an inactive or unset position, showing the directions of the corresponding fluidflows through the blowout preventer and externally of the blowout preventer tubular body as indicated by arrows.
Figure 2:
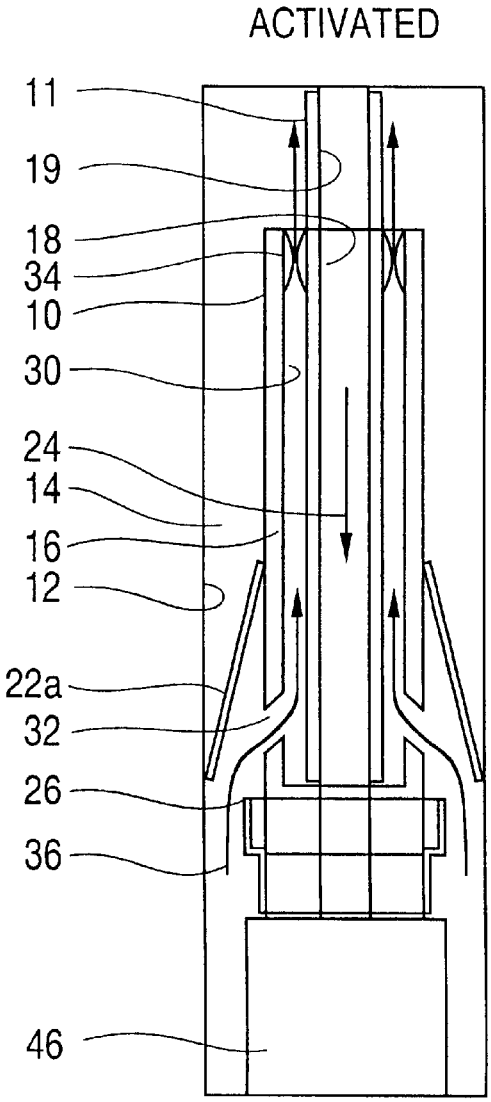
FIG. 2 is similar to FIG. 1, but with the slats of the packer means in their released or set position expanded radially outwards into sealing engagement with the borehole wall, and showing the corresponding fluidflows through the blowout preventer.

It is referred to the drawings, firstly to the schematic illustrations shown in FIGS. 1 and 2, where reference numeral 10 denotes a blowout preventer according to the invention, while 12 denotes a borehole wall and 14 an annulus defined between the exterior of blowout preventer 10 and the borehole wall 12. Blowout preventer 10 is contemplated as being threaded to a drill string 11 in a manner to be aligned with the latter, such that blowout preventer 10 thereby defining with the borehole wall 12 a longitudinal portion of annulus 14, while the drill string 11 and borehole wall 12 define the remaining portion of annulus 14.

The blowout preventer 10 comprises a longitudinal tubular housing 16 having an axial through-bore 18 aligned with bore 19 of the drill string 11 and of a succeeding tool, such as a drill bit 20 (see FIG. 3).

A packer means, generally denoted by reference numeral 22, comprises springy metal slats or ribs 22*a* to be described more in detail later on, in connection with FIGS. 5 through 10. The metal slats are secured at their upstream ends (referred to the downward flow direction which is substantially vertical as indicated by arrow 24) and retained in their retracted positions (FIG. 1) in which the slats down stream end portions are surrounded and retained in this inactive position by means of a movable latching and releasing means 26 as described below in connection with FIGS.

10–13, the slats of the packer means, upon release thereof, expanding laterally to have their outer ends sealingly engage the walls 12 of the wellbore as shown in FIG. 2.

FIGS. 1 and 2 specifically illustrate the fluidflow pattern such as for drilling fluid pumped downhole from the surface to a blowout preventer 10, shown in activated and non-activated positions in FIGS. 1 and 2, respectively.

During normal drilling, with the blowout preventer 10 in inactive position as shown in FIG. 1, back flow of pumped down drilling fluid indicated by arrow 24 takes place in the usual manner, upwards through the annulus 14 as indicated by arrows 28.

When the blowout preventer 10 according to the present invention is released, allowing the packer means 22 to expand into its active sealing position for closing the annulus 14, the situation is as schematically illustrated in FIG. 2.

A tubular body 16 of the blowout preventer 10 is formed with a plurality (e.g. eight) fluid passageways 30 extending parallel to the central bore 18 from end openings or ports 32 to upstream end openings 34 preferably provided with nozzles 34'0 (see FIG. 3A) or similar throttle means opening into the annulus 14.

Fluid flowing through passageways 30 of tubular body 16 in the activated position of the blowout preventer 10 is indicated with arrows 36. 46 refers to a cylindrical housing of the latching and releasing means 26 as described in more detail below.

With reference to FIGS. 3, 3A and 4, the tubular body 16 of the blowout preventer 10 is formed with a central through-bore 18 and eight passageways 30. As detailed in FIG. 3A, the passageways 30 have radially outward and upward diverging discharge portions terminating in removable throttle means 34'.

The slat latching and releasing means 26 is controlled by an actuator generally shown at 44 in FIG. 3. The ports 32 of the internal passageways 30 are here formed longer and narrower than those shown in the schematic illustrations of FIGS. 1 and 2. Below the actuator 44 is an optional downhole motor 47 above drill bit 20.

The packer slats 22*a* are formed from concentrical outer and inner layers of metal slats with an intermediate elastomer.

According to FIG. 3A outer slat layer 22*a'* is attached, such as by threads, at the level of the outlet ends 34 of the internal passageways 30.

Figure 5:
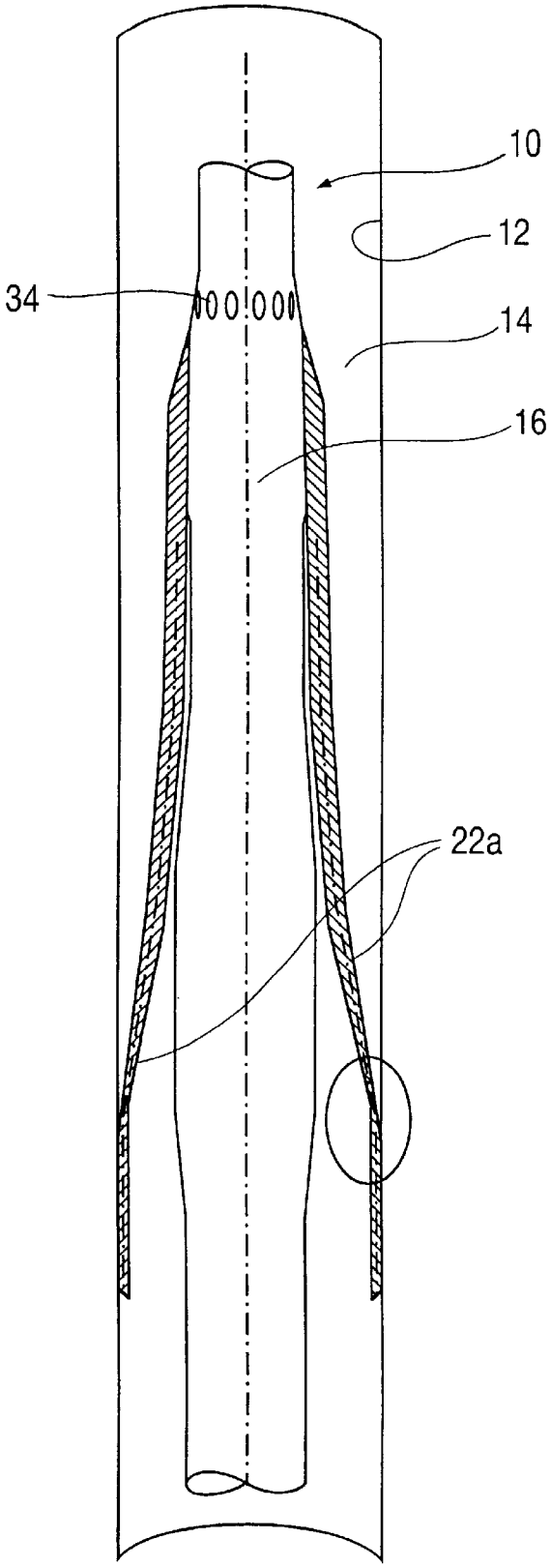
FIG. 5 is a schematic longitudinal cross-sectional view of the blowout preventer showing packer slats in their active, set position.

FIG. 5 *a* shows in greater detail a portion encircled in FIG. 5, consisting of concentric slat layers with an elastomer 22*a'''* between outer slat layer 22*a'* and inner slat layer 22*a''*. The configuration of the packer slats 22*a* according to this embodiment is shown in more detail in FIGS. 6 and 7.

Figure 6:
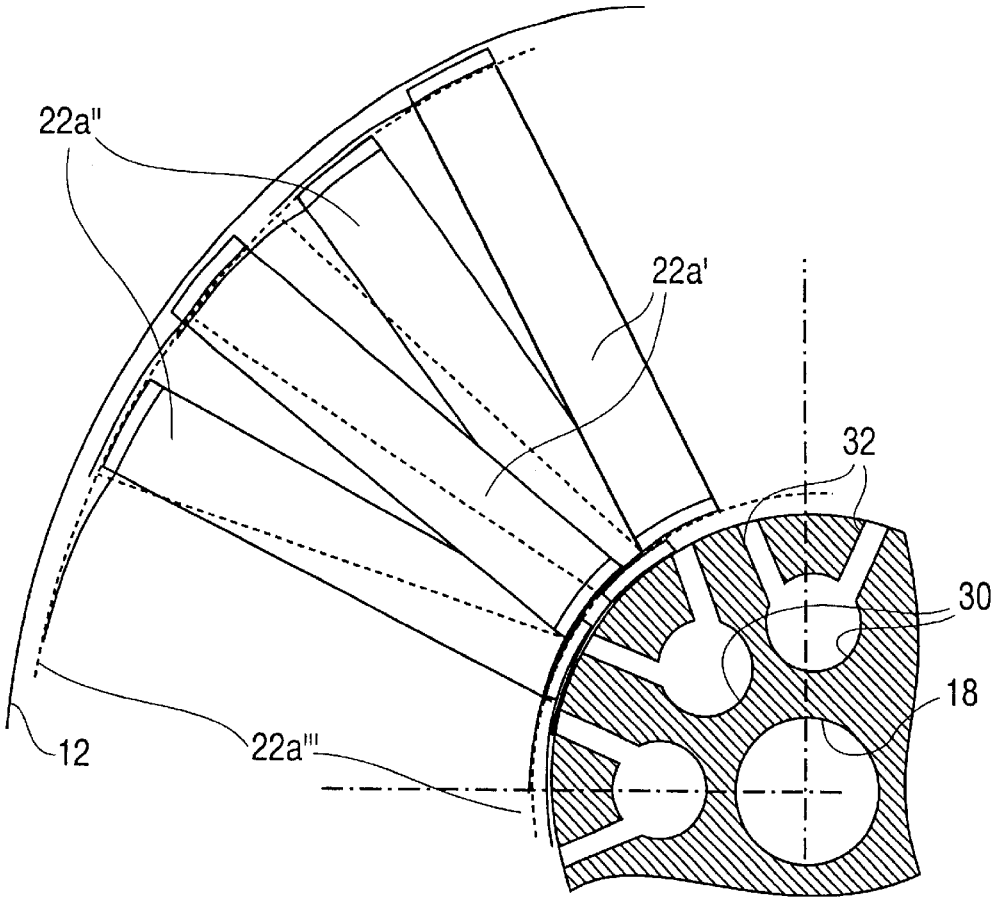
FIG. 6 is a partial lateral cross-sectional view to a larger scale, showing the packer slats in their active position sealingly engaging the wall of the well and illustrating outer and inner slats and elastomer diaphragms incorporated in the packer means.
Figure 7:
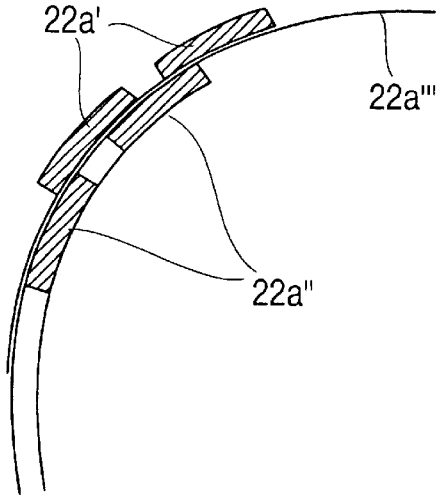
FIG. 7 is a partial view showing the elastomer diaphragms of the packer means vulcanized to an edge of the inner packer slats.

The plan partial views of FIGS. 6 and 7 illustrate the position and peripheral distribution of the outer layer of slats 22*a'*, the inner slats 22*a''* and elastomer diaphragm 22*a'''* (broken thick lines). According to FIG. 7 the elastomeric diaphragm is secured to the edge of each inner slat 22*a''* such as by vulcanization.

Figure 5A:
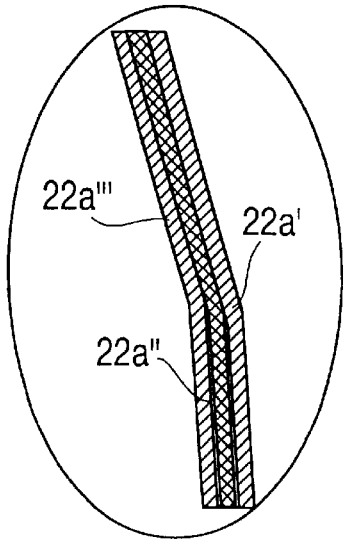
FIG. 5*a* is an enlarged partial view of a portion of the packer slat structure encircled in FIG. 5.
Figure 8C:
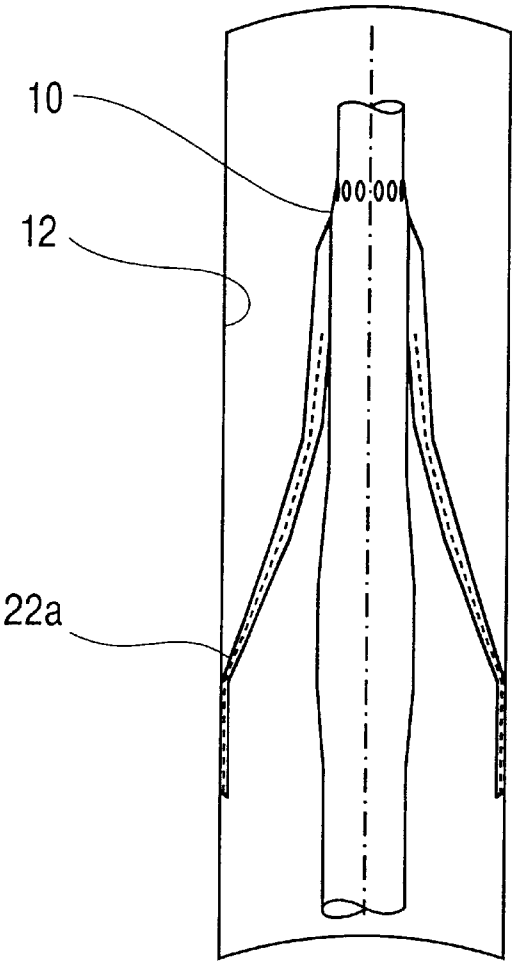
FIGS. 8A–8C are schematic side views of a packer means positioned in a well with its packer slats in set position, in unset position in a normal well (a well having standard cross-section) and in set position in a washed out well (a well having an unusually large diameter), respectively.
Figure 8B:
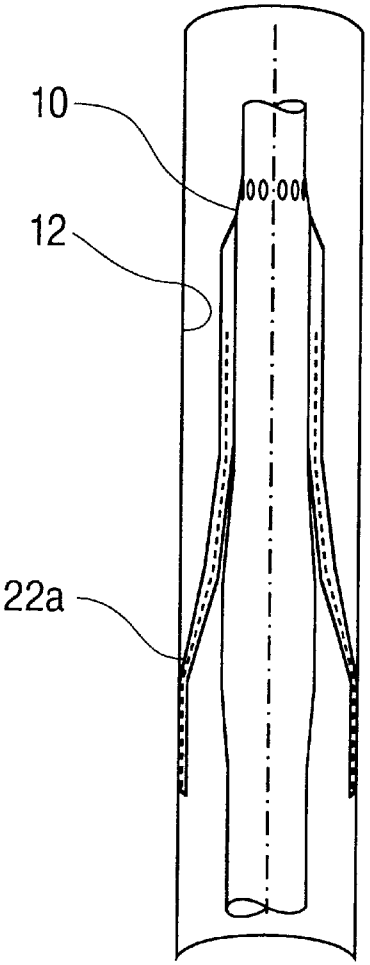
Figure 8A:
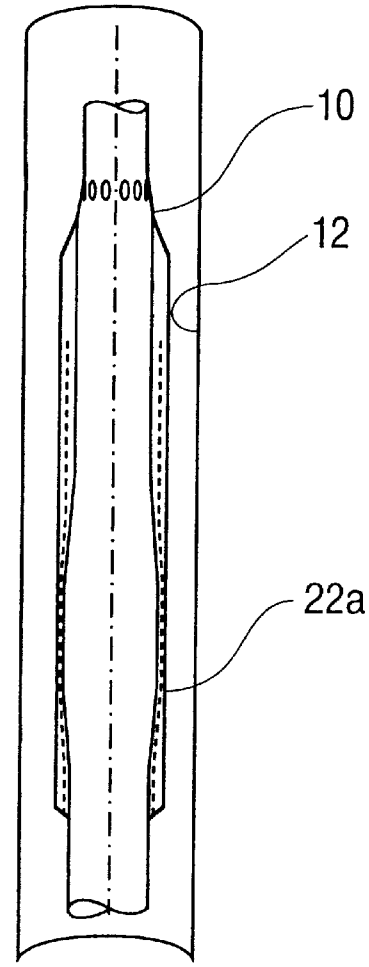
Figure 10:
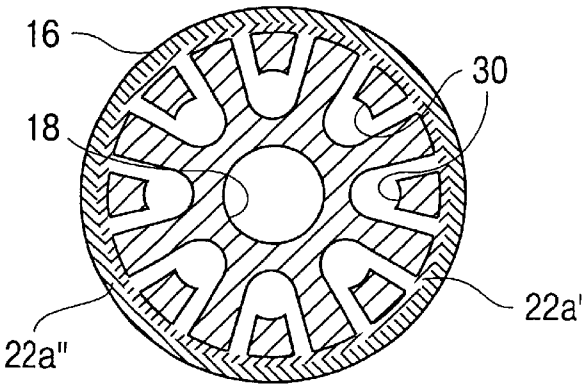
FIG. 10 is a cross-sectional view taken along the line X—X in FIG. 9.
Figure 11:
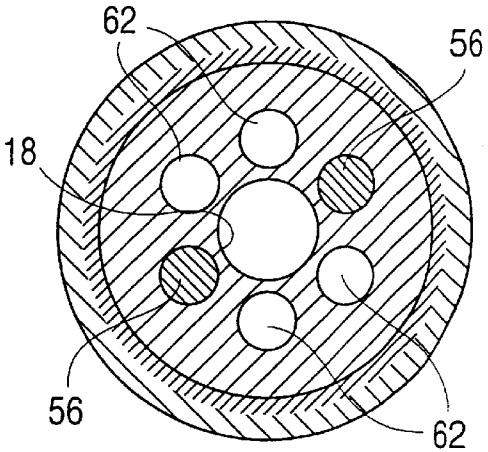
FIG. 11 is a cross-sectional view taken along line XI—XI in FIG. 9.

FIGS. 8A–8C schematically illustrate the positions of the packer slats 22*a*, with non-activated blowout preventer (FIG. 8A) with activated blowout preventer in a normal well (normal diameter) (FIG. 8B), and with activated blowout preventer in a washed out and thus considerably widened well 12' (FIG. 8C), respectively. The inherent springy properties of the suspended slats 22*a*, as a consequence of their design (FIGS. 5A, 6 and 7) provide for a considerable transversal (circumferential) expansion potential of the blowout preventer 10.

FIGS. 9–12 particularly illustrate the construction and function of the actuator 44 associated with the latching and releasing means 26 for the slats 22*a* of the packer means 22. The latching and releasing means 26 comprises an annular rim section 26' surrounding the lower ends of slats 22*a* retaining them in their inactive position. Annular section 26' is coaxially connected to a sleeve-like section 26" slideably disposed along a portion of the blowout preventer's 10 tubular body 16.

A lower portion of the tubular body 16 is surrounded by a tubular housing 46 the inner surface of which defines an annular space 48 with the outer surface of tubular body 16 along a central longitudinal portion thereof. Sleeve portion 26" slidably extends into this annular space 48 with a flanged end section 26A forming 20 an annular piston in the annulus space 48.

Figure 9:
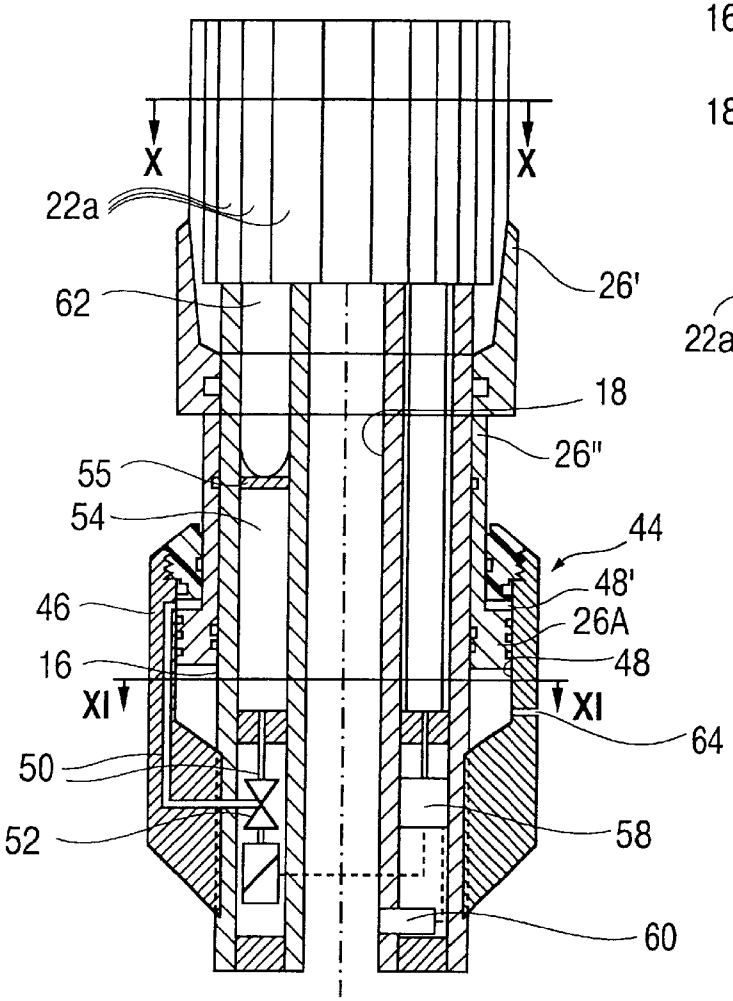
FIG. 9 is an elevational cross-sectional view of the activator of the blowout preventer which operates to actuate the latching and releasing means to release the packer slat ends permitting the slats to spring outward into a sealing position, and showing the slats in their inactive position, retained at their lower end portions by the latching and releasing means.

In the inactive position of the blowout preventer 10, the latching and releasing means 26 is held in an upper position as shown in FIG. 9, leaving a small annular space portion 48' above annular piston 26A. By applying pressurized fluid into this annulus space portion 48', piston 26A and consequently annular rim section 26' will be urged downwards, thus releasing packer slats 22*a* when the upper edge of rim section 26' passes below the lower ends of the slats when moving downward to its bottom end position shown in FIG. 12.

To this effect, annular space portion 48' communicates with an internal oil channel 50 including an electro-hydraulic pilot valve 52 and leading to a longitudinal oil reservoir 54 parallel to the central through-bore 18, the upper portion of which is filled with pressurized gas acting as an accumulator 62. The gas-oil in-terface is denoted by reference numeral 55. Two electrical batteries 56 are disposed parallel to oil reservoir 54, see also FIG. 11. The batteries are connected to an underlying microprocessor 58 and pressure sensor 60.

The latching and releasing means 26 is held in its upper latching position shown in FIG. 9 by any suitable means, such as a shear pin (not shown). The annular space 48 below piston 26A is vented by an aperture 64 through the wall of housing 46.

Figure 12:
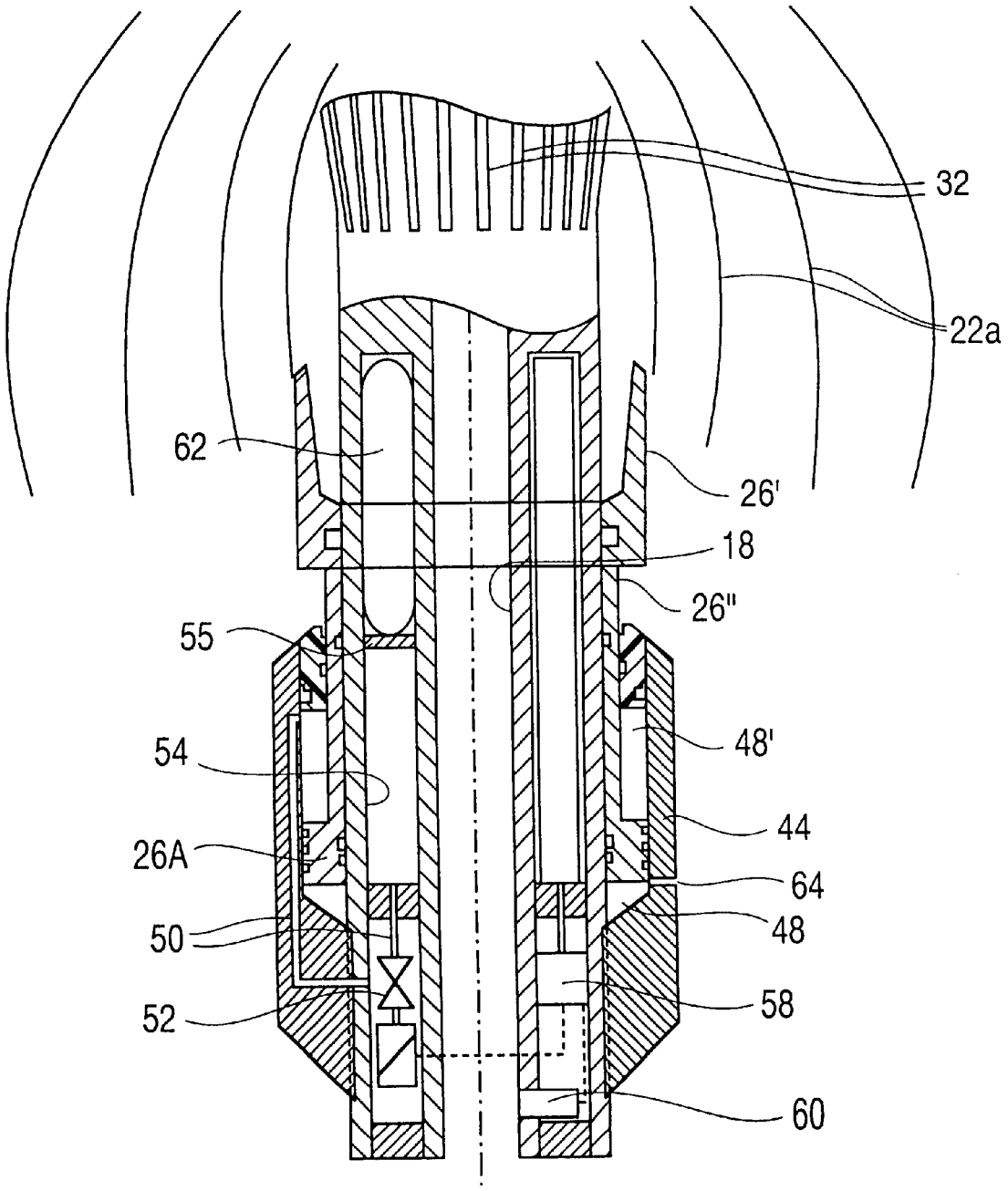
FIG. 12 is similar to FIG. 9, but here the actuator has been operated to actuate the latching and releasing means to displace the latter for releasing the retained portions of the packer slats which, owing to their springy nature, have expanded radially outward into set position.

When the blowout preventer 10 is to be activated, such us from the position shown in FIG. 9 to that shown in FIG. 12, a pressure pulse code is transmitted through the fluid column in the central bore 18 of the drill string central bore 18. Pressure sensor 60 is adapted to react on the pressure pulses in a manner to transmit signals that are received and compared with a pre-programmed code in microprocessor 58. Once agreement is determined upon such comparison, the microprocessor 58 transmits a signal to pilot valve 52, causing (controlling) the latter to permit supply of oil from reservoir 54 pressurized by accumulator 62 into annular space portion 48' via internal oil channel 50, forcing down the latching and releasing means 26 to release packer slats 22*a*, as described above.

In the embodiment shown in the drawings so far, the packer means 22 of the blowout preventer 10 according to the invention could consist of two concentric cylinders split along part of their lengths to define individual slats which, together with the elastomeric diaphragm, form the sealing provided by the blowout preventer according to the invention in its activated, i.e. expanded position. The slats are made of a springy metal material and shaped in such a manner that when released from their inactive position they serve to expand the diameter of the packer means until their outer free end portions engage the walls of the borehole 12 along the periphery of the blowout preventer.

Annular space 14 is now closed off and well fluid downhole of the packer means 22 will flow up through passageways 30 via ports 32 and into annulus 14 uphole of packer means 22 through nozzles 34' at the upper ends of passageways 30. In a critical blowout this would happen within a few seconds, i.e. at the same rate as that of the downhole pressure increase. Formation fluids will now circulate through the passageways 30 and nozzles 34' of the blowout preventer, up through annulus 14 above the packer means 22 to discharge into the sea above the wellbore, to permit heavier drilling mud to circulate down into the well until pressure balance is re-established, such as previously described.

The invention is not limited to the disclosed embodiments. Thus, the configuration of the packer means 22 could be modified based on the embodiment consisting of outer slats 22*a'*, inner slats 22*a"* and intermediate elastomer diaphragm 22*a'"*, in which the slats are made from two concentric cylindrically bent thin metal plates that are split along a certain length to form individual slats 22*a'*, 22*a"* biased towards expanded sealing position, such as shown in FIGS. 8B and 8C, the elastomeric diaphragm 22*a'"* providing the sealing effect. Any other suitably expandable packer element of a similar configuration could be used within the scope of the invention.

Important features of packer means 22 are its configuration and position relative to ports 32 of passages 30. Thus, the function of packer means 22 is two-fold, at least in activated position, where it closes annulus 14 between blowout preventer 10 and wellbore 12, while at the same time uncovering ports 32 of passages 30 to permit fluidflow through the blowout preventer 10 and annulus 14 up-hole, such as previously described.

However, in an embodiment, not shown, the latching and releasing means 26 itself, instead of the end portions of the packer slats 22*a* could be formed, dimensioned and positioned, in the non-activated mode of the blowout preventer 10, in a manner to close ports releasing means 126, actuator 144, hydraulic accumulator 162, oil reservoir 154, interface 155, pilot valve 152, battery 156, microprocessor 158, and pressure sensor 160.

The preferred embodiment of blowout preventer 110 according to the invention differs from the previously shown and described blowout preventer 10, essentially in that the lower end portions 122*b* of packer slats 122*a* which, in the activated or set position of the packer means are adapted to sealingly engage wellbore wall 112, each are connected to the latching and releasing means 126 by a narrow longitudinal connecting element 123. Thus, in the shown embodiment elements 123 are connected to a rim portion 126' at the lower end of the sleeve 126" of the latching and releasing means 126, the sleeve 126" with annular piston 126A being slideably reciprocatably disposed in annular space 148 between cylindrical housing 146 and tubular body 116. Oil channels 150, 150' respectively, extend from oil reservoir 154 via valve 152 to open into upper and lower ends of annular space 148, respectively. Thus, in blowout preventer 110, housing 146 constitutes, together with internal annular piston 126A, a double acting hydraulic cylinder, as opposed to the single acting cylinder 46, 26A of the previous embodiment 10.

Otherwise the components of blowout preventer 110 and its mode of operation upon being activated, is essentially the same as those of the previously de-scribed blowout preventer 10.

Figures 13, 14, 15:
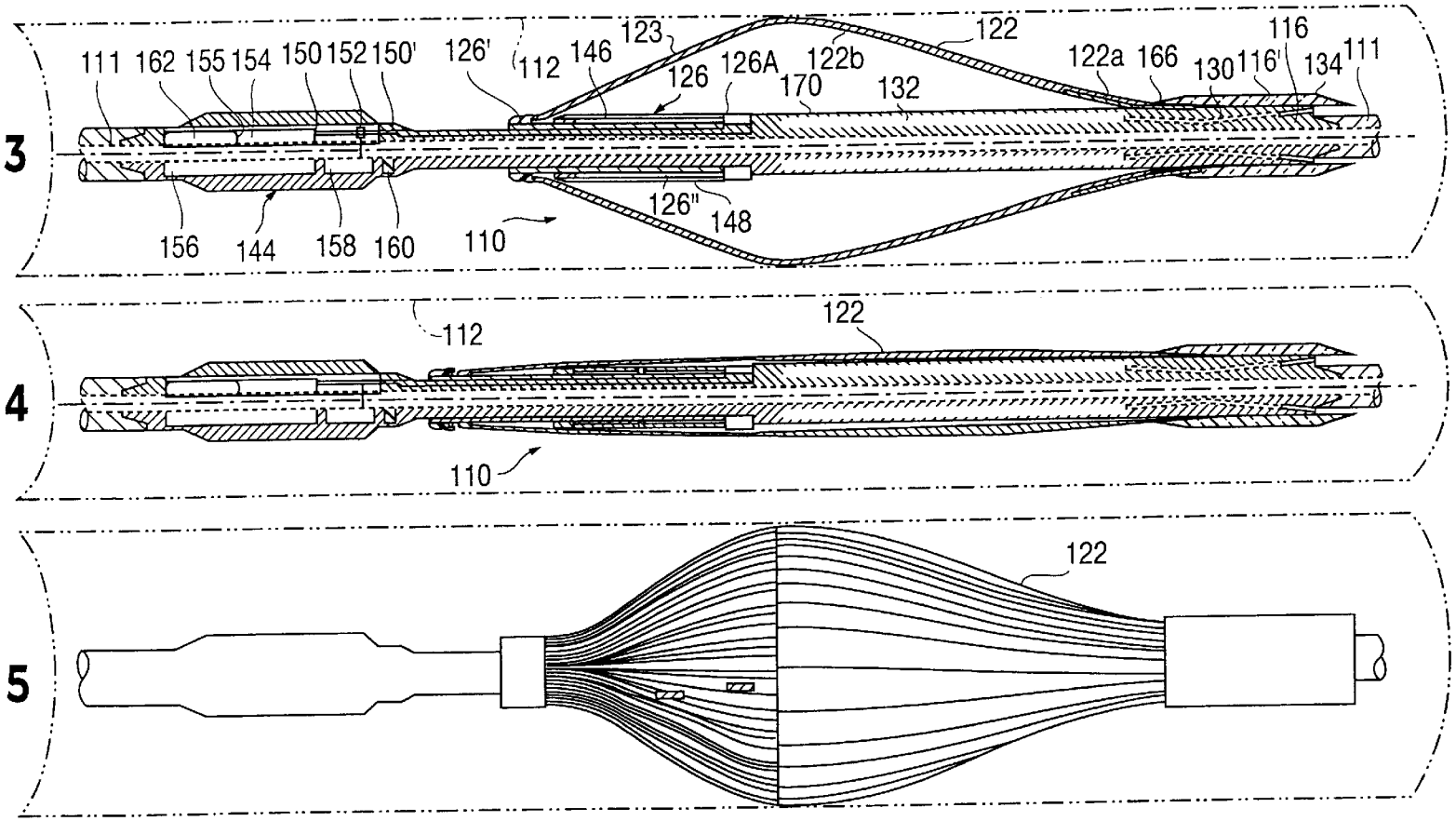
FIGS. 13 and 14 are longitudinal cross-sectional views of a particularly preferred embodiment of a blowout preventer according to the invention, incorporating a deactivateable packer means, shown in activated (expanded) and deactivated (retracted) position, respectively.
FIG. 15 is an elevational view of the blowout preventer of FIGS. 13 and 14 shown in activated or set position.

During running and normal operation of drill string 111 including blowout preventer 110 in deactivated position in wellbore 112 as shown in FIG. 14, the latching and releasing means 126 is retained in its lower end position by means of pressurized fluid applied through channel 150 to annular space 148 above piston 126A. In this manner the connecting elements 123 keep the slats 122*a* stretched to closely engage the exterior surface of tubular body 116, in which the slat lower portions sealingly cover body inlet ports 132.

Upon a signal from the surface via pressure sensor 160 and microprocessor 158, pilot valve 152 opens to permit fluidflow through channel 150' into annular space 148 below piston 126A to force the latching and releasing means 126 up to its upper end position, slackening connecting elements 123 to release the packer slat lower end portions 122*b* such that these, by their inherent springiness assisted by the pressure of the up-flowing fluid in well-annulus 114 are urged radially outward to sealingly engage the wellbore wall 112 in the activated mode of blowout preventer 110, as illustrated in FIG. 13 and in FIG. 15.

Connection elements 123 are narrow enough to permit well fluids to flow freely in between them and in under the packer slats 122*a*. Moreover, connecting elements 123 possess a certain degree of rigidity, such that initially at the moment of release during the upward travel of sleeve 126, they transmit thrust to the slat end portions 122*b* to rapidly urge the latter radially outward and permitting the well fluid in below the slats expanding them further toward the wellbore wall.

The slats 122*a* of blowout preventer 110 could be of a design substantially similar to that of slats 22*a* of the previously described embodiment 10, having the lower end portions of the slats suitably connected to connecting elements 123. The latter could be formed of any suitable material.

Figure 16:
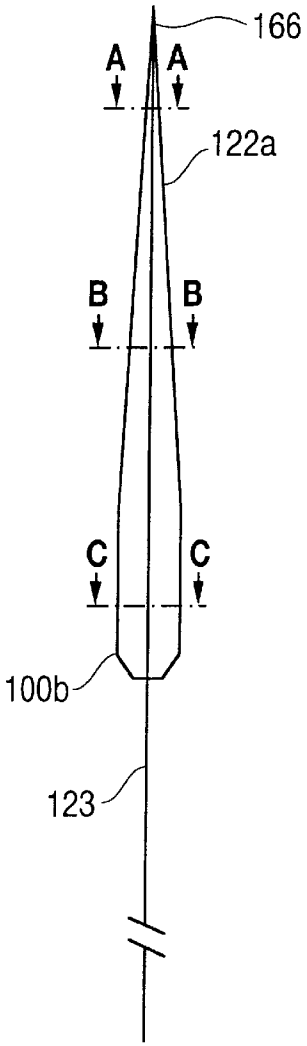
FIG. 16 is a plan view of a slat to be used in the blowout preventer according to FIGS. 13–15.
Figure 17:
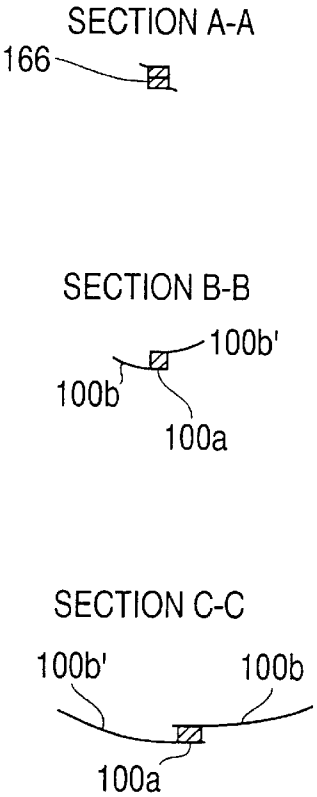
FIG. 17 includes three cross-sectional views of slat of FIG. 16, taken along the 1 lines A—A, B—B and C—C respectively in the latter figure, and FIG. 18 schematically shows a sector of a cross-section through slats according to FIGS. 16 and 17 of the packer means in activated and deactivated position respectively in the area corresponding to the cross sectional lines C—C in FIG. 16.
Figure 18:
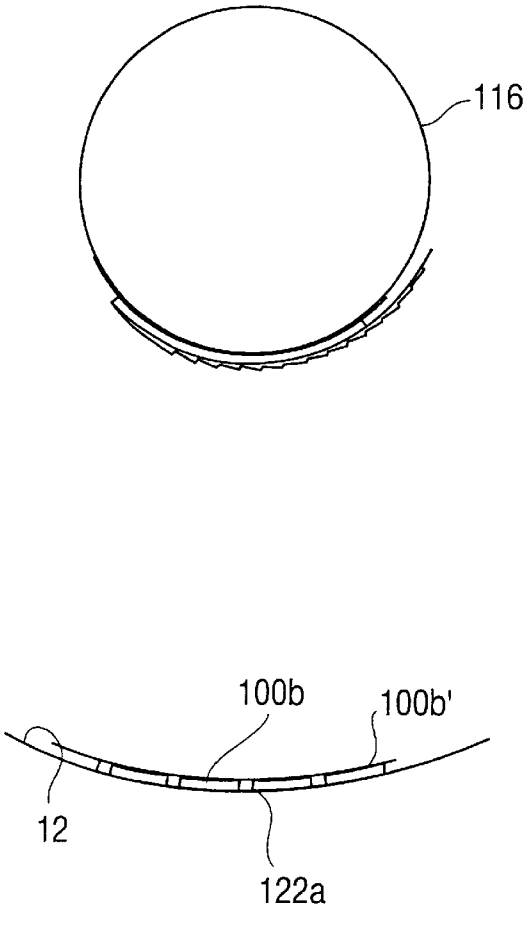

However, packer slats 122*a* of a somewhat modified form as appearing from the plan view of FIG. 16 and sections according to FIG. 17, are preferred for embodiment 110. They generally consist of a long relatively thick bracing element 100*a* supporting a long, substantially triangularly tapering, outer packer sheet 100*b* extending in one lateral direction from bracing element 100*a* and an inner packer sheet 100*b'* extending from the bracing element in a lateral direction opposite from that of outer sealing sheet 100*b* and separated therefrom by the thickness bracing element 100 *a*, as appearing from the cross-sections according to FIG. 17. The connection elements 123 are here depicted simply as suitably configured extensions of the bracing elements 100*a*. FIG. 18 schematically illustrates a sector of a cross-section through packer means 122 in the area along section line C—C in FIG. 16, showing how the slats 122 of the packer sheets 100 *b*, 100*b'* overlappingly cover each other in their deactivated positions retracted toward the tubular body 116, and in their activated positions expanded into engagement with the borehole wall 112. Along an end portion of the slat attachment 122*a'* the thickness of each slat bracing element 100*a* is preferably split longitudinally a certain distance by a cut 166, such as shown in FIGS. 13 and 17.

The extension elements 123 also act as a screen to prevent solid particles in the well fluid in annulus 114 from entering the interior of the packer. Preferably there is also a screen means 170, such as a metal mesh, around tubular body 116 in the area at the longitudinal ports 132.

Although not shown in FIGS. 13–18 the slats of the packer means 122 could be provided with intermediate elastomer sealing diaphragm as in the previous packer means 22.

What is claim is:

1. A blowout preventer, adapted to be incorporated in a drill string, said blowout preventer comprising:

a tubular body having a central through-bore aligned with a bore of the drill string and at least one passageway having a fluid inlet and a fluid outlet, the at least one passageway extending substantially parallel with the central through-bore;

a radially and circumferentially expandable packer means being shiftable between a retracted, inactive position for permitting fluidflow in an annulus defined between the drill string and a wall of a wellbore and a released, expanded position for sealing with the wall of the wellbore; and a latching and releasing means being moveable between a latched position for preventing said packer means from expanding and an unlatched position for releasing said packer means and permitting said packer means to expand into the released, expanded position, wherein at least one of said packer means and said latching and releasing means is configured and positioned relative to the fluid outlet such that when said packer means is in the retracted, inactive position or said latching and releasing means is in the latched position, the fluid inlet is covered and closed, and when said packer means is in the released, expanded position, the fluid inlet is uncovered and opened.

2. A blowout preventer according to claim 1, wherein:

said packer means has a circumferential fastening portion fastened to said tubular body and a free edge portion opposite to said circumferential fastening portion, and said packer means is configured along a certain length to form a plurality of springy slats;

when said latching and releasing means is in the latched position, said latching and releasing means is operable to engage said free edge portion of said packer means and when said latching and releasing means is moved to the unlatched position, said plurality of springy slats radially and circumferentially expand into the released, expanded position; and said latching and releasing means has an annular retainer section and a sleeve section, said annular retainer section being connected to said sleeve section and said sleeve section being slideably disposed along a portion of said tubular housing or a guiding portion coaxially connected with said tubular housing.

3. A blowout preventer according to claim 2, wherein said packer means comprises two concentric, cylindrically configured, springy metal sheets and an intermediate elastomer diaphragm locate in between said two concentric, cylindrically configured, springy metal sheets such that said plurality of springy slats comprise outer and inner slats, said outer and inner slats and said intermediate elastomer diaphragm forming a three-layer slat assembly, and wherein said outer and inner slats have a rectangular, triangular, or trapezoidal circumferential shape.

4. A blowout preventer according to claim 1, further comprising a nozzle provided at the fluid outlet.

5. A blowout preventer according to claim 2, further comprising a surrounding tubular housing, wherein said sleeve section of said latching and releasing means is provided with an annular piston reciprocatingly disposed in an annular space defined between said tubular body and said surrounding tubular housing, said annular piston being acted upon by pressurized fluid supplied to the annular space.

6. A blowout preventer according to claim 5, further comprising:

a pressure fluid reservoir;

an internal pressure fluid channel leading from said pressure fluid reservoir to one side of said annular piston in the annular space;

a pilot valve operable to open and close said internal pressure fluid channel;

a pressure sensor operable to respond to a pressure code transmitted from a surface position through a fluid column in the bore of the drill string and said blowout preventer and in response to the pressure code, said pressure sensor being further operable to transmit sensor signals; and a microprocessor connected to said pilot valve and said pressure sensor, said microprocessor being operable to receive the sensor signals, compare the sensor signals with a preprogrammed code, and, upon agreement, transmit signals to control said pilot valve.

7. A blowout preventer according to claim 6, wherein said pressure fluid reservoir is filled with oil and a volume of pressurized gas.

8. A blowout preventer according to claim 1, wherein the at least one passageway is a plurality of passageways equidistantly disposed circumferentially about the central through-bore.

9. A blowout preventer according to claim 8, wherein the fluid outlets of the plurality of passageways divert radially outwards.

10. A blowout preventer according to claim 2, further comprising longitudinal connecting elements connected between downstream end portions of said plurality of springy slats and said latching and releasing means, said longitudinal connecting elements being operable to shift said packer means to the retracted, inactive position by movement of said latching and releasing means towards the latched position.

* * * * *